US006209744B1

(12) United States Patent
Gill

(10) Patent No.: US 6,209,744 B1
(45) Date of Patent: Apr. 3, 2001

(54) HINGE-DOORED RECEPTACLE

(76) Inventor: Ward P. Gill, 2850 Centerwood, Fayetteville, AR (US) 72703

( * ) Notice: Subject to any disclaimer, the term of this patent is extended or adjusted under 35 U.S.C. 154(b) by 0 days.

(21) Appl. No.: 09/320,233

(22) Filed: May 26, 1999

(51) Int. Cl.[7] ..... B65D 43/26
(52) U.S. Cl. ..... 220/263; 220/264; 220/908
(58) Field of Search ..... 220/263, 264, 220/908; 312/319.9

(56) References Cited

U.S. PATENT DOCUMENTS 3,825,215 * 7/1974 Borglum ..... 220/908 X
4,883,189 * 11/1989 Lobbert ..... 220/908 X
4,907,715 * 3/1990 Bloomer ..... 220/263
5,163,574 * 11/1992 Sosan ..... 220/263 X
5,348,222 * 9/1994 Patey ..... 220/908 X
5,372,271 * 12/1994 Miller et al. ..... 220/263
5,538,338 * 7/1996 Biggers ..... 220/263 X
5,671,859 * 9/1997 Sheu et al. ..... 220/263
6,000,569 * 12/1999 Liu ..... 220/263
6,024,238 * 2/2000 Jaros ..... 220/263 X

FOREIGN PATENT DOCUMENTS

4132958 * 5/1992 (DE) .

* cited by examiner

*Primary Examiner*—Nathan J. Newhouse
(74) *Attorney, Agent, or Firm*—Joe D. Calhoun

(57) ABSTRACT

An improvement to a hinge-doored receptacle having a housing and a door hinged thereto, said improvement comprising a gradual closure means functionally attached between said housing and said door to facilitate the gradual return of said door to said resting closed position.

21 Claims, 1 Drawing Sheet

HINGE-DOORED RECEPTACLE

STATEMENT REGARDING FEDERALLY SPONSORED DEVELOPMENT

Not Applicable.

BACKGROUND OF THE INVENTION

The invention described herein generally relates to devices and systems governing the opening and closing of receptacles. More particularly, the present invention is an improvement to pedal activated trash receptacles.

In many business and fast food restaurants, customers are provided with trash receptacles having a swinging door hinged across the top. It is often difficult to dispose of trash through the swinging door, since the door often tends to swing down against the trash and thereby prevent it from being easily dumped into the receptacle. It is generally a two-hand operation, one for holding the door open and the other for dumping the trash into the receptacle. A customer carrying a child, briefcase or the like therefore has a very difficult time assisting the establishment in disposing of trash. Equally important, the return swing of an open receptacle door may have sufficient force to, if the customer is caught off guard, either injure the fingers or hand of the customer or cause some of the trash to be spilled upon the customer or the premises. It should also be noted that a customer's use of his or her hands to push trash through receptacle door may be extremely unsanitary. Often the customer feels compelled to wash his or her hand at the conclusion of the meal, due to the touching of the trash receptacle.

Various types of door openers are known, but all have certain limitations. The following patented receptacles are known in the art.

| Patent Number | Inventor |
|---|---|
| 5,147,056 | Ma |
| 5,372,271 | Miller, et al. |
| 4,765,548 | Sing |
| 5,048,712 | Wolters |
| 5,163,574 | Sosan |
| 3,799,430 | Huguenin |
| 4,907,715 | Bloomer |
| 5,398,374 | Betancourt |
| 5,172,823 | Moetteli |
| 5,011,026 | Hausman |
| 4,609,122 | Ziegenbein |
| 4,729,490 | Ziegenbein |
| 3,891,115 | Ono |
| 5,538,338 | Biggers |
| 4,150,764 | Anderson |

The receptacle disclosed in Miller is complicated to manufacture and assemble, and it is not readily adaptable for the retrofitting of existing receptacles. The receptacle disclosed in Ma is somewhat less complicated to manufacture and assemble, but it fails to disclose any means facilitating the gradual return of the open door to its closed position. Biggers discloses a receptacle having a stoop mechanism to prevent the lid from pivoting outwardly from the receptacle cabinet, but without any means facilitating the gradual return of the open door to its closed position. Ziegenbein discloses a receptacle having a time delay switch allowing the door to return to its closed position after a pre-selected time interval. However, the mechanism for such delayed return is extremely complicated, and it usually requires an electrical power source for activation which is not always available by receptacles and would be costly to install and operate. Although the Ziegenbein receptacle provides for delayed closure of the receptacle door, it fails to allow for the gradual return of the receptacle door to its closed resting position. It is also too complex and costly for retrofitting existing receptacles.

There is known a foot-actuated top-opening receptacle sold under the trademark Mipro, (probably made by the White Mipro company in Tampa, Fla.) that includes a gas spring to control the closing of the lid. However, there are substantial differences between that receptacle and the invention disclosed herein. For instance, both the manner of actuating the opening and the manner of controlling the closing are distinctly different in both receptacles. The Mipro receptacle has an externally mounted lever system, with the lid essentially being pushed upward into the open position by the lever, and with the gas spring being attached at opposite ends to both the lid and the push-lever to control the closing; this configuration has the disadvantages of having exposed external parts that form possible "pinch points" that could injure children or unwary adults, and the exposed parts are not as aesthetically pleasing as the relatively clean appearance of internally actuated receptacles. Moreover, there is no information known as to the date of invention of the Mipro receptacle.

SUMMARY OF THE INVENTION

In general, this invention relates to an improvement to a hinge-doored receptacle having a housing and a door hinged thereto, said improvement comprising a gradual closure means attached in a functional relationship between said housing and said door to facilitate the gradual return of said door from an open position to a closed position. Said gradual closure means may be anchored to said housing and attached to either said hinged door or to something connected to said door such as (for example) a force application means urging said door from a resting closed position to an open position; said improvement may include a gradual closure means functionally attached to said force application means to facilitate the gradual return of said open door to said resting closed position upon sufficient reduction of said urging from said force application means. Alternatively, said gradual closure means maybe functionally attached directly to said hinged door to facilitate the gradual return of said door from an open position to a resting closed position.

The invention disclosed herein more easily retrofits existing systems than anything presently existing. The invention easily retrofits almost any trash receptacle, without adversely affecting the original integrity of the receptacle. The invention requires minimal space within the trash receptacle. One can still open an auxiliary door of the trash receptacle to empty the trash container. The invention can be easily installed on either the left side or the right side of almost any trash receptacle. The invention can also be easily installed on almost any trash receptacle regardless of whether it is atop a pedestal. The invention can also be easily installed on trash receptacles having mounted wheels. And if manual opening of the hinged door is desired, the invention does not prevent such manual operation.

A primary object of this invention is to provide a simpler means of actuating a hinge-doored receptacle. Another object of the invention is to provide a simple means of facilitating the gradual return of said open door to its closed resting position. Another object is to provide a simple means to improve the safety and sanitation of existing hinge-doored trash receptacles. Another object is to provide such improvements that are easily manufactured. Another object is to provide such improvements that are easily assembled. Another object is to provide such improvements that are easy to retrofit into an existing receptacle. Another object is to provide such improvements that are economical to manufacture, install, maintain and replace.

BRIEF DESCRIPTION OF DRAWINGS

The following describes the drawings accompanying this application, which are incorporated herein.

DETAILED DESCRIPTION OF THE INVENTION

Figure 1:
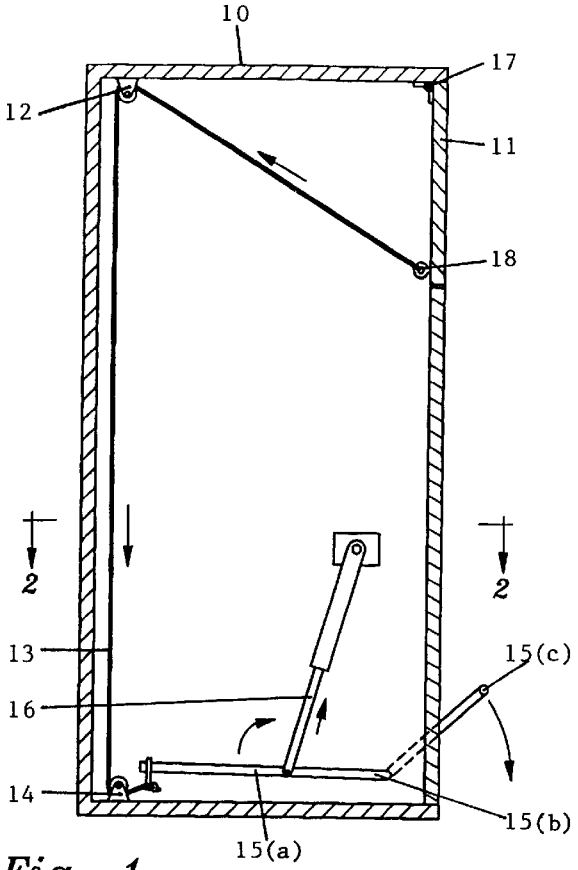
FIG. 1 depicts a side elevational view of one version of the invention in the resting (closed) position (absent the side panel of the housing, opposite the side through which the pedal-activated lever is inserted and pivotally mounted). Note that, at point 15(*b*), the horizontally aligned lever member 15(*a*) corners essentially perpendicularly and continues through an aperture in the housing side panel, emerging exterior to the housing and ending with an adaptation to facilitate activation by the foot, such as (for example) a pedal adapted for depression by the foot either on that side of the receptacle or extending curvedly around to the front of the receptacle; the dashed line in FIG. 1 represents the extension of said force application means (after said comer) through said housing side panel and exteriorly behind said panel. At the point of 15(*c*), said force application means comers essentially perpendicularly and ends in a foot pedal for activation at the front of the receptacle. Said aperture through said housing side panel may include material to prevent the wear and tear on said panel or on said force application means, or to facilitate the ease of pivoting of said force application means, such as (for example) grommet or bushing material.

For the sake of simplicity and to give the claims of this patent application the broadest interpretation and construction possible, the following definitions will apply:

1. distal means relatively further from;
2. latitudinal means in an essentially vertical direction, relative to a point of reference such as (for example) a door or a hinge;
3. longitudinal means in an essentially horizontal direction, relative to a point of reference such as (for example) a door or a hinge; and
4. proximal means relatively closer to.

Also for the sake of simplicity, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

The invention disclosed herein is not limited by construction materials to the extent that such materials satisfy the structural or functional requirements. For example, a housing may be constructed from any materials satisfying the requirements that the housing both house items within and provide support for a door hingedly attached thereto. A gradual closure means may be constructed of any materials, so long as it satifies the requirement that it facilitates the gradual return of the door from an open position to a closed position. A hinged door may be made of any materials, so long as it allows said door to pivot open and closed. A force application means may be made of any materials, so long as it satisfies the requirement that force urging such pivoting is transmitted to said door, and the requirement that it may be functionally attached to said gradual closure means.

In its most general form, the invention includes an improvement to a hinge-doored receptacle having a housing, a door hinged thereto, and a force application means for urging said door from a resting closed position to an open position, said improvement comprising a gradual closure means (16) functionally attached to said force application means facilitating the gradual return of said open door to said resting closed position upon sufficient reduction of said urging from said force application means. Said gradual closure means may be selected from the group consisting of compression springs (including pneumatic or hydraulic), gears, ratchets and tension springs, and combinations thereof.

In particular said improvement may include a compression spring having one end anchored to said housing and having another end attached to said force application means, said compression spring moveable between a resting expanded position and a compressed position corresponding to the respective resting closed position and the open position of the hinged door, said spring compressing by said urging of said force application means, the reduction of said urging causing said spring to return gradually to its resting expanded position and thereby facilitate the gradual return of said door to its resting closed position. More particularly, said compression spring may include a gas compression spring such as (for example) that marketed under the mark Lift-o-Mat® (requiring about 10 pounds of pressure for activation), manufactured by Stabilus in Colmar, Pa.

Said force actuation means may be selected from the group consisting of non-electrical or non-battery operated pedal-actuated levers, and gears, and combinations thereof, attached to a linkage system means (attached to said hinged door).

One version of the hinge-doored receptacle is comprised of a housing (10) having a hinged (17) door (11) movable between a resting closed position and an open interior-accessing position, said movement actuated by a force application means urging said resting closed door (FIG. 1) toward said open position (FIG. 3), said door returning to said resting closed position upon sufficient reduction in said urging by said force application means. As an example applicable to the version of the invention including a foot-actuated pedal, said reduction may be accomplished by removing the foot from depressing the pedal. Also included is a gradual closure means functionally attached to said force application means facilitating gradual return of said door to said resting closed position.

In one version of the receptacle, said force application means is a lever having one end attached to an essentially taut linkage system means functionally attached to said door distal to said hinge(s). Said linkage system means may include at least one and possibly a plurality of pass-through capture means along a linkage means. Said capture means essentially provide guidance and/or stabilization for the linkage means along its route between the force application means and the door, and said capture means may include a plurality of capture means situated essentially downwardly from said door attachment along said linkage means. Said capture means may be located at any place(s) between said door attachment and any portion of a linkage means wherein a functional relationship is maintained. For example, one upper capture means may be mounted to the interior of said housing opposite (yet proximal to) said door attachment (for example, in the upper-right back comer of the housing), whereas a lower capture means may be mounted essentially beneath said upper capture means proximal to said force application means (yet distal to said door attachment), for example, in the lower-right back corner of the housing. Said capture means may be selected from the group consisting of eyelet screws, closure hooks, U-nails and pulleys, and combinations thereof Said linkage means may be selected from the group consisting of rope, cord, cable, belt and chain, and combinations thereof In one preferred version of the invention, said capture means is an eyelet screw (18), a first pulley (12) and a second pulley (14), and said linkage means is cable (13).

In one version of the receptacle, said lever is comprised of a foot-actuated pedal. Said gradual closure means may be comprised of a compression spring having one end anchored to said housing and having another end attached to said lever, said compression spring moveable between a resting expanded position and a compressed position, said spring compressing by said urging of said force application means, the reduction of said urging causing said spring to return gradually to its expanded resting position and thereby facilitate the gradual return of said door to its resting closed position. More particularly, said compression spring is comprised of a gas compression spring.

One preferred embodiment of the improved hinge-doored trash receptacle is comprised of a housing having an exterior and an interior and a door hingedly attached thereto, said housing also having an interior portion latitudinally proximal to said hinge and an interior portion distal to said hinge, said door having a corresponding exterior and interior, said door interior having an edge latitudinally distal from said hinge, said door pivotal at said hinge at least in the direction from essentially said housing exterior toward said housing interior between a resting closed position and an open trash-receiving position. Said pivoting actuated by a lever having at least a force-accepting end, a linkage end and an intermediate fulcrum component, said lever moveable from a resting closed position to an open position; said force-accepting end is situated to accept an external force moving said lever end essentially in a direction away from said door movement (from said resting closed position to said open trash-receiving position), whereas said linkage end is situated in said housing interior to move essentially in a direction opposite from said force-accepting end movement. This embodiment includes an elongate and flexible linkage element having at least two opposite ends at least semi-tautly linking said door with said lever linkage end; end one of said linkage element is attached to said door near said interior distal edge, end two of said linkage element is threaded through a first capture means distal from said hinge and also threaded through a second capture means further distal from said hinge and attached to said lever linkage end. Also included is a gradual closure means functionally attached to said lever, facilitating gradual return of said door to said resting closed position.

Like the other versions of the invention, said linkage element may be selected from the group consisting of rope, cord, cable, belt and chain, and combinations thereof Similarly, said capture means may be selected from the group consisting of eyelet screws, closure hooks, U-nails and pulleys, and combinations thereof.

In another version of the receptacle, said housing has a front and rear longitudinal orientation and an upper and lower latitudinal orientation, said housing including at least a front vertical wall defining an upper portal, said front wall having a correspondingly sized door hingedly attached and at least substantially hanging in a resting position within and essentially obstructing said portal, said housing including at least a vertical side wall supporting said lever fulcrum component attached at a lower level than said door distal edge, said force-accepting end including a depression end having a resting position above the surface upon which said receptacle is situated. In this version, said first capture means may be a pulley or eyelet screw attached to said housing interior at approximately the same latitudinal level as said hinge, and said second capture means may be a pulley or eyelet screw attached to said housing interior at approximately the same latitudinal level as said lever linkage end in its resting closed position; said linkage element may be a cable or rope that, when said door and said lever are in their respective resting closed positions, tautly links said door to said lever.

In another version of the receptacle, said housing is essentially a rectangulo-cuboidal box having a top and bottom connected by opposing front and back walls and a pair of side walls, said front wall including at least one hinged door. Said lever fulcrum component is comprised of a straight pivotal rod having an exterior end and an interior end, and impaling a lower front portion of a side wall. Said linkage-accepting end is essentially an "L" shaped rod having a shorter end attached to an exterior end of said pivotal rod and having a longer end adapted to function as a foot pedal. Said lever linkage end is a substantially straight rod attached at a front-most end essentially perpendicularly to said interior end of said pivotal rod. Said gradual closing means is a gas compression spring having a lower end attached to said lever near said linkage end and having an upper end anchored to said side wall.

Figure 3:
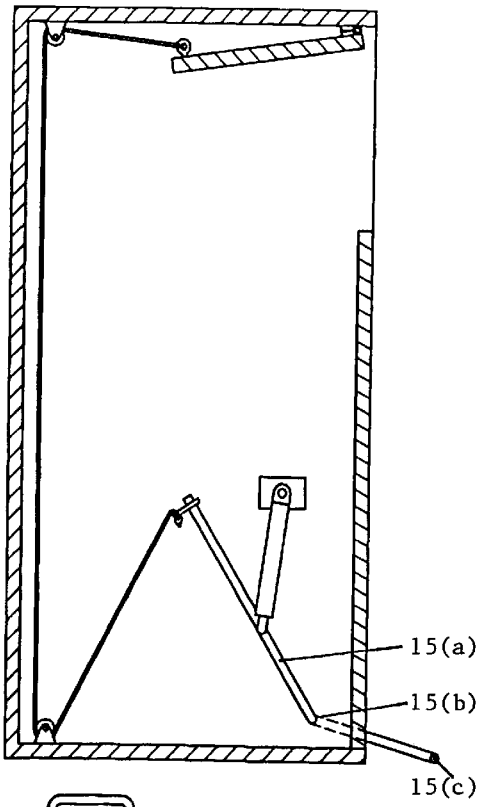
FIG. 3 depicts a side elevational view of one version of the invention, in an open position (absent the side panel of the receptacle, opposite the side through which the foot pedal-lever is inserted and pivotally mounted); included are a force application means (depressed foot pedal adaptation and diagonally aligned lever member) functionally attached to one version of a gradual closure means (16) (gas compression spring).
Figure 2:
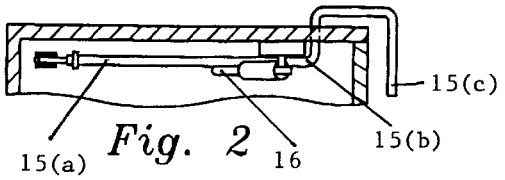
FIG. 2 depicts a top plan view of the version of the invention depicted in FIG. 1; this view depicts the relationship between various aspects of the force application means such as the horizontally aligned lever member 15(*a*), corner point 15(*b*) and corner point 15(*c*).

For some of the versions of the invention disclosed herein, there are five primary parts. Most of the parts are common items found at any hardware store. As illustrated in FIG. 1 and FIG. 3, the five primary parts are: (a) a lever (15), (b) a gas spring (16), (c) two pulleys (12 and 14), (d) a cable (13), and (e) an eyelet screw (18). The design of the lever is simple and can be easily mass produced in most machine shops. The actual installation may take less than twenty minutes and includes four easy steps.

STEP 1: Installing the lever. Mark the point where a ½ inch drill bit is to drill. Drill a ½ inch hole. Choose the appropriate lever: either one made for a right side installation or one made for a left side installation. Maneuver the lever through the hole to engage large oversized screw threads. Start threading the screw threads into the hole; then, once the threads have caught, use a ½ inch open ended wrench to finish screwing the oversized screw threads until the outer edge is flush with the trash receptacle outside wall. Insert one cotter pin into the two holes located on the lever so that the large oversized screw piece is positioned between the two holes.

STEP 2: Installing the Gas Spring. Attach the free end of the gas spring to the arm of the lever inside the trash receptacle as shown in FIGS. 1 and 3. Attach the housing having the gas spring to the inside of the trash receptacle wall.

STEP 3: Installing the Eyelet Screw and two Pulleys. Attach the eye screw and two pulleys as shown in FIGS. 1 and 3.

STEP 4: Attaching the Cable. Attach the wire cable as shown in FIGS. 1 and 3 so that there is no slack in the cable, and the cable is at least semi-taut.

The invention described herein also includes a method of making afoot-actuated hinge-doored receptacle, comprising the step of mounting gradual closing means to a receptacle housing and force application means. In particular, said method includes the steps of anchoring one end of a gas compression spring to the interior of a housing, and attaching the other end to the interior end of a lever.

More specifically, said method includes the steps of: (1) boring a hole in a lower frontward comer of a side wall of said receptacle; (2) inserting through said hole a pivot rod having a foot-actuated force-accepting end attached to an exterior end of said pivot rod; (3) attaching a linkage-actuating lever end to an interior end of said pivot rod; (4) attaching a gas compression spring end to said linkage-actuating lever, and mounting a base of said gas compression spring on an interior side of said side wall essentially above said linkage-actuating lever end; (5) attaching one end of a cable to a second end of said linkage-actuating lever end; (6) threading the other end of said cable through a pulley mounted near said second end of said linkage-actuated lever end, through another pulley mounted near the upper rear portion of said housing; and (7) attaching said other end of said cable to a hinged door of said receptacle, near the interior edge of said door distal from said hinge.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

I claim:

1. An improvement to a hinge-doored receptacle having a housing, a door hinged thereto, and a force application means for urging said door from a resting closed position to an open position, said improvement comprising a gradual closure means functionally attached within said housing to a side wall of said housing and to said force application means facilitating the gradual return of said door to said resting closed position upon sufficient reduction of said urging from said force application means.

2. An improvement described in claim 1, wherein said gradual closure means is comprised of a compression spring having one end anchored to said housing and having another end attached to said force application means, said compression spring moveable between a resting expanded position and a compressed position corresponding to the respective resting closed position and the open position of the hinged door, said spring compressing by said urging of said force application means, the reduction of said urging causing said spring to return gradually to its resting expanded position and thereby facilitate the gradual return of said door to its resting closed position.

3. An improvement described in claim 2, wherein said compression spring is comprised of a gas compression spring.

4. An improvement described in claim 2, wherein said force actuation means is comprised of a pedal-actuated lever attached to a linkage system means attached to said hinged door.

5. A hinge-doored receptacle comprising:

a housing having a hinged door movable between a resting closed position and an open interior-accessing position, said movement actuated by a force application means urging said resting closed door toward said open position, said door returning to said resting closed position upon sufficient reduction in said urging by said force application means; and a gradual closure means functionally attached within said housing to a side wall of said housing and to said force application means facilitating gradual return of said door to said resting closed position.

6. A hinge-doored receptacle as described in claim 5, wherein:

said force application means is a lever having one end attached to an essentially taut linkage system means functionally attached to said door for linking said force application means to said door.

7. A hinge-doored receptacle as described in claim 6, wherein said linkage system means is comprised of linkage means for linking said force application means to said door, and at least one means providing guidance for said linkage means along its route.

8. A hinge-doored receptacle as described in claim 7 wherein said capture means is comprised of a plurality of said capture means situated essentially linearly between said door and said linkage means.

9. A hinge-doored receptacle as described in claim 7, wherein:

said capture means is selected from the group consisting of eyelet screws, closure hooks, U-nails and pulleys, and combinations thereof.

10. A hinge-doored receptacle as described in claim 7, wherein said linkage means is selected from the group consisting of rope, cord, cable, belt and chain, and combinations thereof.

11. A hinge-doored receptacle as described in claim 7, wherein said capture means is an eyelet screw, a first pulley and a second pulley, and said linkage means is cable.

12. A hinge-doored receptacle as described in claim 6 wherein said lever is comprised of a foot-actuated pedal.

13. A hinge-doored receptacle as described in claim 5, wherein said gradual closure means is comprised of a compression spring having one end anchored to said housing and having another end attached to said lever, said compression spring moveable between a resting expanded position and a compressed position, said spring compressing by said urging of said force application means, the reduction of said urging causing said spring to return gradually to its expanded resting position and thereby facilitate the gradual return of said door to its resting closed position.

14. A hinge-doored receptacle as described in claim 13, wherein said compression spring is comprised of a gas compression spring.

15. An improved hinge-doored trash receptacle comprising:

a housing having an exterior and an interior and a door hingedly attached thereto, said housing also having an interior portion latitudinally proximal to said hinge and an interior portion latitudinally distal to said hinge, said door having a corresponding exterior and interior, said door interior having an edge distal from said hinge, said door pivotal at said hinge at least in the direction from essentially said housing exterior toward said housing interior between a resting closed position and an open trash-receiving position;

said pivoting actuated by a lever having at least a force-accepting end, a linkage end and an intermediate fulcrum component, said lever moveable from a resting closed position to an open position, said force-accepting end situated to accept an external force moving said lever end essentially in a direction away from said door movement,from said resting closed position to said open trash-receiving position, said linkage end situated in said housing interior to move essentially in a direction opposite from said force-accepting end movement;

an elongate and flexible linkage element having at least two opposite ends at least semi-tautly linking said door with said lever linkage end, end one of said linkage element attached to said door with a first means for capturing said end one to said door near said interior distal edge, end two of said linkage element threaded through a first means distal from said hinge for guiding said linkage element along its route, end two also threaded through a second guidance means further distal from said hinge, end two attached to said lever linkage end; and a gradual closure means functionally attached within said housing to a side wall of said housing and to said lever facilitating gradual return of said door to said resting closed position.

16. A hinge-doored trash receptacle as described in claim 15, wherein:

said linkage element is selected from the group consisting of rope, cord, cable, belt and chain, and combinations thereof;

said guidance means is selected from the group consisting of eyelet screws, closure hooks, U-nails and pulleys, and combinations thereof.

17. A hinge-doored trash receptacle as described in claim 16, wherein:

said housing has a front and rear longitudinal orientation and an upper and lower latitudinal orientation, said housing including at least a front vertical wall defining an upper portal, said front wall having a correspondingly sized door hingedly attached and at least substantially hanging within and essentially obstructing said portal, said housing including at least a vertical side wall supporting said lever fulcrum component attached at a lower level than said door distal edge, said force-accepting end including a depression end having a resting position above the surface upon which said receptacle is situated;

said first capture means is an eyelet screw attached to said hingedly attached door, distal from the latitudinal level of said hinge, said first guidance means is a pulley attached to said housing interior at approximately the same latitudinal level as said hinge, said second guidance means is a pulley attached to said housing interior at approximately the same latitudinal level as said lever linkage end in its resting closed position; and said linkage element is a cable that, when said door and said lever are in their respective resting closed positions, tautly links said door to said lever.

18. A hinge-doored trash receptacle as described in claim 17, wherein:

said housing is essentially a rectangulo-cuboidal box having a top and bottom connected by opposing front and back walls and a pair of side walls;

said lever fulcrum component is comprised of a straight pivotal rod having an exterior end and an interior end, and impaling a lower front portion of a side wall, said linkage-accepting end is essentially an "L" shaped rod having a shorter end attached to an exterior end of said pivotal rod and having a longer end adapted to function as a foot pedal, said lever linkage end is a substantially straight rod attached at a front-most end essentially perpendicularly to said interior end of said pivotal rod; and said gradual closing means is a gas compression spring having a lower end attached to said lever near said linkage end and having an upper end anchored to said side wall.

19. A method of making a foot-actuated hinge-doored receptacle, comprising the step of mounting gradual closing means within a receptacle housing, to a side wall of said housing and to a force application means for urging said door from a resting closed position to an open position.

20. A method of making a foot-actuated hinge-doored receptacle as described in claim 19, more particularly comprising the steps of anchoring one end of a gas compression spring to the interior of a housing, and attaching the other end to the interior end of a lever.

21. A method of making afoot-actuated hinge-doored receptacle as described in claim 20, more specifically comprising the steps of:

boring a hole in a lower frontward comer of a side wall of said receptacle;

inserting through said hole a pivot rod having a foot-actuated force-accepting end attached to an exterior end of said pivot rod;

attaching a linkage-actuating lever end to an interior end of said pivot rod;

attaching a gas compression spring end to said linkage-actuating lever, and mounting a base of said gas compression spring on an interior side of said side wall essentially above said linkage-actuating lever end;

attaching one end of a cable to a second end of said linkage-actuating lever end;

threading the other end of said cable through a pulley mounted near said second end of said linkage-actuated lever end, through another pulley mounted near the upper rear portion of said housing; and attaching said other end of said cable to an eyelet screw in a hinged door of said receptacle, near the interior edge of said door distal from said hinge.

* * * * *